United States Patent [19]

Hayashi et al.

[11] Patent Number: 4,602,473

[45] Date of Patent: Jul. 29, 1986

[54] METHOD AND APPARATUS FOR REPLACING AIR WITHIN A CONTAINER HEAD SPACE

[75] Inventors: Masayuki Hayashi; Yukio Yamaguchi; Masatoshi Suzuki, all of Nagoya, Japan

[73] Assignee: Mitsubishi Jukogyo Kabushiki Kaisha, Tokyo, Japan

[21] Appl. No.: 717,471

[22] Filed: Mar. 28, 1985

Related U.S. Application Data

[63] Continuation of Ser. No. 393,086, Jun. 28, 1982, abandoned.

[51] Int. Cl.[4] ..... B65B 31/04

[52] U.S. Cl. ..... 53/510; 53/432

[58] Field of Search ..... 141/70; 53/432, 510

[56] References Cited

U.S. PATENT DOCUMENTS

| | | | |
|---|---|---|---|
| 2,362,799 | 11/1944 | Boyd | 53/432 |
| 2,380,434 | 7/1945 | Heince | 141/70 X |
| 2,630,957 | 3/1953 | Hohl | 53/432 X |
| 2,660,352 | 11/1953 | Renard | 141/70 |
| 2,672,420 | 3/1954 | Jeremiah | 141/70 X |
| 2,692,715 | 10/1954 | Doudera, Jr. | 226/68 |
| 3,246,447 | 4/1966 | Smith | 53/510 |

FOREIGN PATENT DOCUMENTS

| | | | |
|---|---|---|---|
| 1438364 | 6/1976 | United Kingdom | 141/70 |

*Primary Examiner*—John Sipos

*Attorney, Agent, or Firm*—Wenderoth, Lind & Ponack

[57] ABSTRACT

Just before a container is sealed by a container sealing apparatus or a container has a sealing body fed to its narrow-mouth by a sealing body feeder, an inert gas is blown into a head space of the container to replaced air present in the head space, and thereafter the container is immediately sealed or a sealing body is fed thereto to sealingly confine the inert gas within the head space. Preferably prior to the above-mentioned step, a heated gas is fed into the head space of the container which has been filled with a liquid to eliminate bubbles existing within the head space and remove the air trapped in the bubbles by the thermal energy of the heated gas. An apparatus to be used for practicing the above method is also disclosed.

1 Claim, 9 Drawing Figures

METHOD AND APPARATUS FOR REPLACING AIR WITHIN A CONTAINER HEAD SPACE

This application is a continuation of now abandoned application Ser. No. 393,086 filed June 28, 1982.

The present invention relates to a method and an apparatus for replacing air within a head space of a container, and more particularly to such a method and an apparatus for replacing air remaining in a head space of a container filled with a liquid by a container filling apparatus by an inert gas such as a carbon dioxide gas, a nitrogen gas, an argon gas, etc.

Figure 1:
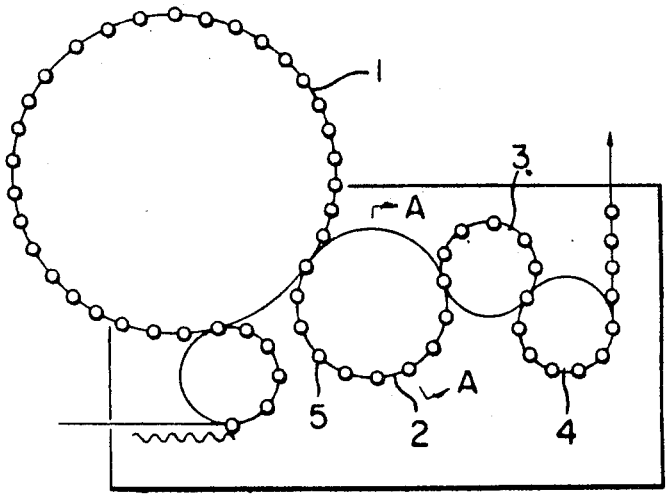
Figure 2:
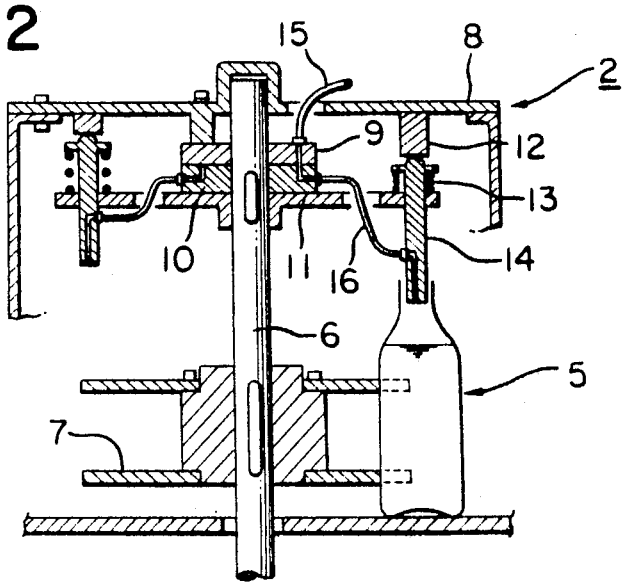

In general, foods, medicines, cosmetics, etc. are oxidized by air, resulting in degradation of their quality, and therefore, in some cases an apparatus for replacing air remaining in a container head space by an inert gas is provided in a filling line for containers. FIGS. 1 and 2 show one example of such an apparatus in the prior art, in which reference numeral 1 designates a filling machine, numeral 2 designates a star wheel transfer device, numeral 3 designates a sealing machine, and numeral 4 designates a star wheel ejecting device. A container 5 filled with a liquid by the filling machine 1 is transferred to the sealing machine by means of the star wheel transfer device 2 to be sealed by a crown, a cap or the like, and during the period when the container is being transferred from the filling machine 1 to the sealing machine 3, an inert gas is blown into a head space of the container to replace the air therein.

FIG. 2 shows a cross-section view of the star wheel transfer device 2 taken along line A—A in FIG. 1. The star wheel transfer device 2 is constructed of a star wheel 7 keyed to a rotary shaft 6 so as to rotate integrally therewith for transferring containers 5, fixed disks 8 and 9 loosely fitted around the top portion of the shaft 6, rotary disks 10 and 11 keyed to the rotary shaft 6 so as to rotate integrally therewith, a cam 12 mounted on the lower surface of the fixed disk 8, an inert gas blowing nozzle 14 mounted to the rotary disk 11 in a vertically movable manner and urged upwardly by a spring 13 so that its top end will butt against the cam 12, and hoses 15 and 16 for feeding an inert gas. During the period when the container 5 is being transferred, the nozzle 14 is lowered into a head space of the container 5 and an inert gas fed through the hose 15, fixed disk 9, rotary disk 10 and hose 16 is blown into the container head space from the tip end of the nozzle 14. As the rotation of the rotary members and the container 5 proceeds, the nozzle 14 is raised, at the same time the feeding of the inert gas is interrupted between the fixed disk 9 and the rotary disk 10, and the container 5 is further transferred continuously towards the sealing machine 3.

However, in the above-described air replacing apparatus in the prior art, even though an inert gas is blown into the container head space to replace the air therein, during the period when the nozzle is extracted from the container and the period before the container has been transferred to the sealing machine and sealed thereby, the inert gas would be replaced again by air, and so, there has been a problem that eventually the replacement percentage [that is, (amount of replaced inert gas/initial amount of air within a container head space)$\times$100] has been greatly lowered. By way of example, in the case of a bottle of 100 ml capacity, a head space after filling of about 16 cc and a processing capability of 660 BPM, the amount of carbon dioxide gas blown into the bottles was about 100 cc/bottle and the replacement percentage measured after sealing was about 3%. This is considered to be due to the fact that during operation of the apparatus, assuming that the bottles are transferred at a velocity V of 1 m/sec, the static pressure in the bottle neck portion is lowered by about 50 mm ($V^2/2g=1000^2/2\times9800\approx50$) air column, and hence the replaced carbon dioxide gas flows out of the bottle and is again replaced by air.

On the other hand, another method called the "water jet system" has been practiced in the prior art, in which during the period when a container filled with a liquid is being transferred by a star wheel transfer device to a sealing machine, high-pressure water is injected into the container to foam the liquid within the container and thereby purge the air remaining in the head space.

By way of example, especially in the case of beer, a method is known, in which high-pressure water is injected into the head space of a container that has been filled with beer, and after the beer has been made to overflow from the container by applying a physical force to the beer within the container to make it foam and thus the remaining air has been removed, a stopper is inserted into the container. However, the method has the disadvantages that the concentration of carbon dioxide gas in the product is lowered because the beer was made to foam and also due to the overflow there is a loss of liquid and contamination of the environment of the machine.

Figure 3:
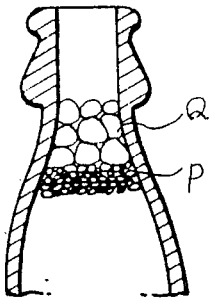

In addition, in an apparatus designed to blow an inert gas such as a carbon dioxide gas into the head space of a container that has been filled with a liquid, in view of the mechanism for filling the container with a liquid, in practice, within the head space of the container a considerable amount of foam has always been generated on the top surface of the liquid. Especially in the case of beer, further classifying the foam as shown in FIG. 3, there exist a creamy foam P principally consisting of carbon dioxide gas that has been separated from the liquid itself during the filling process right above the liquid level, and large bubbles Q (commonly called "crab bubbles") produced as a result of expansion of bubbles formed by trapping air within the container during the filling process when they were released under the atmospheric pressure above the creamy foam a. These crab bubbles especially have a nature which makes them difficult to eliminate by a conventional method. In a high-speed filling and stopper-inserting system, the time interval between the filling and the stopper-inserting is very short, and due to the foam and bubbles produced, only an apparent head space is reduced. When an inert gas is injected into the head space under such a condition, even if 100% of the air in the apparent head space is replaced by the inert gas, the air in the crab bubbles will not be replaced, and as a result, the replacement percentage has not been improved to a desirable extent in practice. The present invention has been worked out against the above-described background of the art.

It is therefore one object of the present invention to provide an improved method for replacing air within the head space of a container, in which air remaining in the head space of a container that has been filled with a liquid can be surely replaced with an inert gas.

Another object of the present invention is to provide an improved apparatus for replacing air within the head space of a container, which can surely replace air remaining in the head space of a container that has been filled with a liquid with an inert gas.

According to one feature of the present invention, there is provided a method for replacing air within the head space of a container by an inert gas after the container has been filled with a liquid and then sealing the container, including the steps of blowing an inert gas into the head space of the container just before said container is sealed by a container sealing apparatus or just before a sealing body is fed to a narrow-mouthed portion of the container by a sealing body feeder, and thereafter immediately sealing or feeding a sealing body to sealingly confine said inert gas within the head space of the container.

According to another feature of the present invention, there is provided a method for replacing air within the head space of a container by an inert gas after the container has been filled with a liquid and then sealing the container, including the steps of at first feeding a heated gas into the head space of the container after the container has been filled with a liquid to eliminate bubbles existing within said head space for removing air trapped within said bubbles, subsequently transferring the container towards a sealing station, blowing an inert gas into the head space of the container just before said container is sealed by a container sealing apparatus or just before a sealing body is fed to a mouth portion of the container by a sealing body feeder, and thereafter immediately sealing or feeding a sealing body to sealingly confine said inert gas within the head space of the container.

According to still another feature of the present invention, there is provided an apparatus for replacing air within the head space of a container, in which a nozzle adapted to blow an inert gas into the head space of the container just before it is sealed or a sealing body is fed thereto, is disposed so as to be directed towards the head space of said container at a position under a sealing plunger in a container sealing apparatus or under a sealing body feeding chute of a sealing body feeder.

According to yet another feature of the present invention, there is provided an apparatus for replacing air within the head space of a container, in which a bubble eliminating device for eliminating bubbles within the head space of the container by blowing a heated gas into the head space of the container being transferred from a container filling apparatus to a container sealing apparatus after it has been filled with a liquid, is disposed on a container transfer device between the container filling apparatus and the container sealing apparatus, and a nozzle adapted to blow an inert gas into the head space of the container just before it is sealed or a sealing body is fed thereto, is disposed so as to be directed towards the head space of said container at a position under a sealing plunger in the container sealing apparatus or under a sealing body feeding chute of a sealing body feeder.

According to the present invention, since an inert gas is blown into the head space of the container just before said container is sealed or just before a sealing body is fed and thereafter immediately it is sealed or a sealing body is fed thereto to sealingly confine the inert gas, the inert gas once blown into the head space will not flow out, and thus the air remaining within the head space is surely replaced by the inert gas.

Furthermore, according to the present invention, since a heated gas is preliminarily fed into the head space of the container which has been filled with a liquid to eliminate bubbles existing within the head space by the thermal energy of the heated gas and after all the air remaining within the head space including the air contained in the bubbles has been removed an inert gas is blown into the head space and it is sealed or a sealing body is fed thereto to sealingly confine the inert gas, the remaining air can be more surely replaced by the inert gas.

In addition, according to the present invention, since an inert gas can be blown into the head space of the container through the nozzle disposed in the above-described manner and thereafter immediately it is sealed or a sealing body is fed thereto by a sealing plunger or a sealing body feeding chute, the inert gas is surely confined in a sealing manner.

Moreover, according to the present invention, since a heated gas is blown into the head space of the container being transferred by a bubble eliminating device disposed in the above-described manner to transfer the container to the container sealing apparatus while the bubbles are eliminated and thus the remaining air is removed and in the container sealing apparatus an inert gas is blown into the head space and immediately it is sealed or a sealing body is fed thereto, it is possible to sealingly confine the inert gas within the head space after the remaining air has been completely removed.

Figure 4:
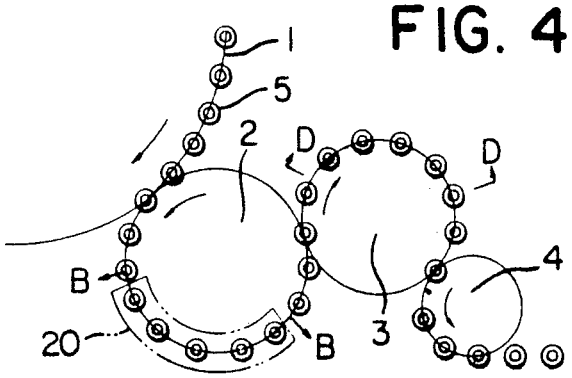
Figure 5:
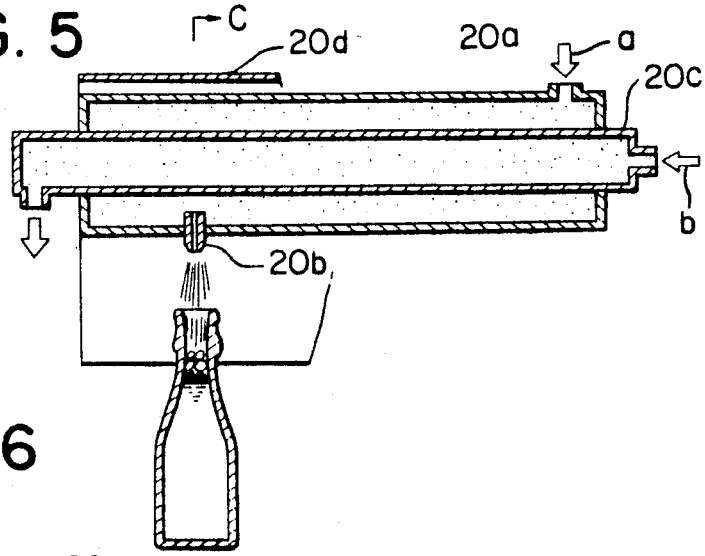
Figure 6:
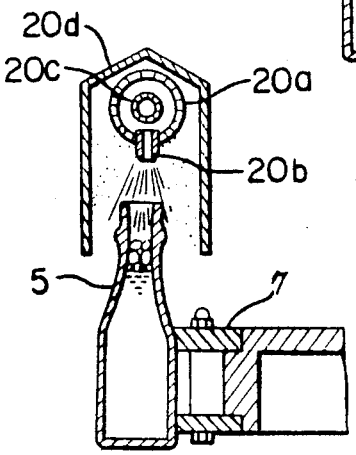
Figure 7:
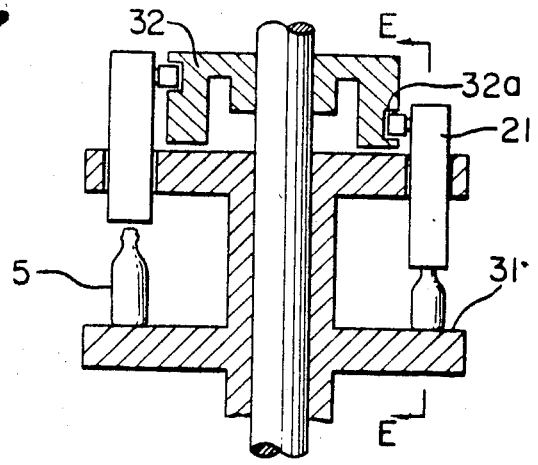
Figure 8:
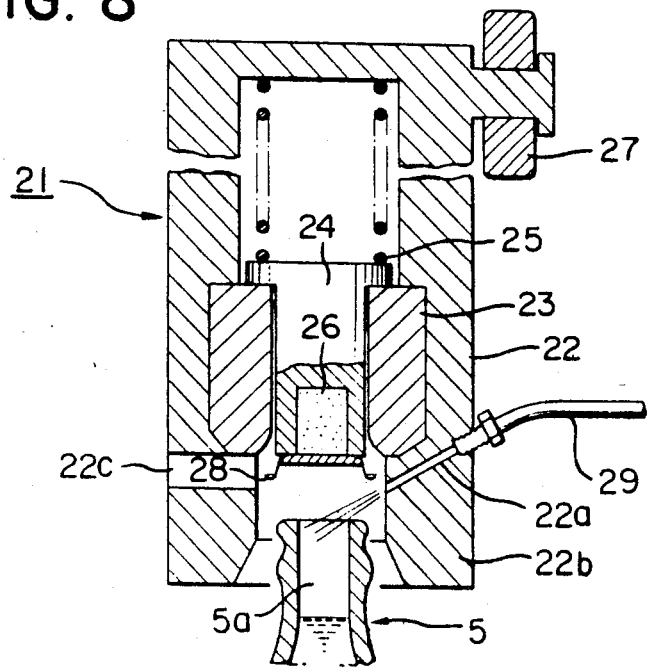
Figure 9:
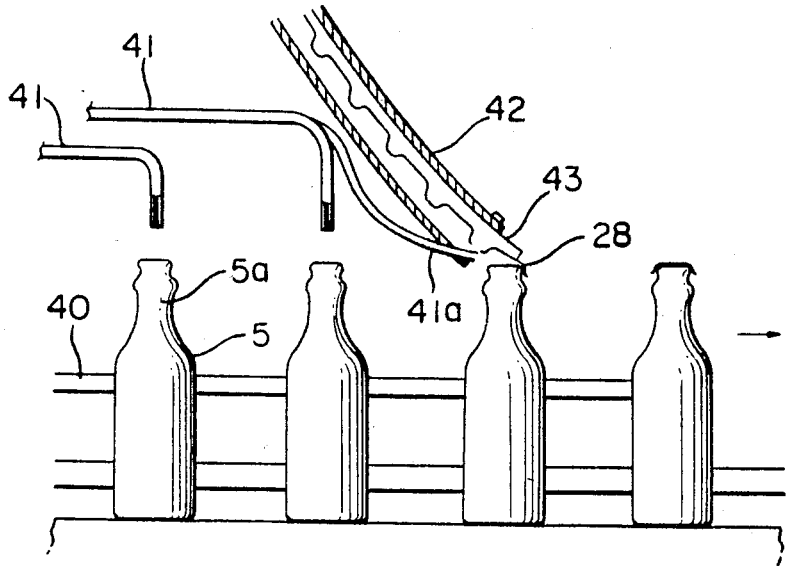

The above-described and other objects, features and advantages of the present invention will become more apparent by reference to the following description of preferred embodiments of the invention taken in conjunction with the accompanying drawings, wherein:

FIG. 1 is a plan layout view showing one example of a filling machine and a sealing machine of the prior art, FIG. 2 is a cross-section view taken along line A—A in FIG. 1, FIG. 3 is a cross-section view showing the head space of a container after the container has been filled with a liquid, FIG. 4 is a plan layout view showing one preferred embodiment of the present invention, FIG. 5 is a cross-section view taken along line B—B in FIG. 4, FIG. 6 is a cross-section view taken along line C—C in FIG. 5, FIG. 7 is a cross-section view taken along line D—D in FIG. 4, FIG. 8 is a cross-section view taken along line E—E in FIG. 7, and FIG. 9 is a cross-section view of another preferred embodiment of the present invention.

Now the present invention will be described in greater detail in connection with the preferred embodiments. In FIG. 4, reference numeral 1 designates a filling machine, numeral 2 designates a star wheel transfer device, numeral 3 designates a sealing machine, numeral 4 designates a star wheel ejecting device, numeral 5 designates containers, and numeral 20 designates a bubble eliminating device. A container 5 filled with a liquid by the filling machine 1 is transferred by the star wheel transfer device 2 to the sealing machine 3, where the container 5 is sealed and thereafter ejected to the subsequent station, and normally during the period when the container 5 is being transferred from the filling machine 1 to the sealing machine 3, air remaining in the head space is removed.

The bubble eliminating device 20 is adapted to blow a heated gas into the head space of a container 5 that is being transferred by a star wheel 7 forming part of the star wheel transfer device 2. As shown in FIGS. 5 and 6, the bubble eliminating device 20 is constructed of a semi-annular casing 20*a* to which a heated gas a is fed, a nozzle 20*b* provided on the bottom surface of the casing 20*a* and adapted to blow out a sufficiently heated dry gas towards a container 5, a heating pipe 20*c* provided within the casing 20*a* and having a heating stream b supplied through one end thereof and ejected through the other end, and a semi-annular cover 20*d* provided to make the heated gas blown out through the nozzle 20*b* not diffuse but stagnate in the proximity of the mouth portion of the container 5. The cover 20*d* is semi-annular in shape and extends along the path of the containers: which are moved by the star wheel towards the sealing machine 3, i.e. to the right in FIG. 5. The nozzle 20*b* is provided near the entrance end of the cover 20*d* such that containers pass by nozzle 20*b* and move towards the sealing machine. In this bubble eliminating device 20, the heated gas fed as shown by an arrow a is sufficiently heated and dried by the heating steam supplied as shown by an arrow b, and then it is blown out through the nozzle 20*b*.

It is to be noted that as the heated gas a, besides steam, an inert gas such as a carbon dioxide gas, a nitrogen gas, an argon gas, etc. can be employed. In addition, although the heated gas is further heated and dried by the heating steam b supplied to the heating pipe 20*c* in the above-described embodiment, an electric heater or the like could be utilized therefor.

Because of the operation of the mechanism for filling a container, in a container which has been just filled with a liquid by the filling machine, a considerable amount of foam is necessarily always generated in the head space thereof.

Especially in the case of beer, as shown in FIG. 3 there exist the creamy foam P consisting of small-sized bubbles, and large bubbles Q called "crab bubbles", and while the inside of the small-sized bubbles of the foam P is almost filled by carbon dioxide gas, the inside of the crab bubbles Q is almost occupied by air.

The container 5 after being filled with a liquid having such bubbles containing air therein retained in its head space, is transferred towards the sealing machine 3 by the star wheel transfer device 2, and during this transfer process, under the bubble eliminating device 20 from which the heated gas blown out of the nozzle 20*b* is blown into the head space. The heated gas blown into the head space supplies heat to the surfaces of the bubbles, and in the case where the heated gas is steam it adheres to the bubble surfaces in the form of wet steam, and hence destroys the balance of the surface tensions forming the bubbles, and thereby eliminates the bubbles successively.

On the other hand, owing to existence of the cover 20*d*, in the proximity of the narrow-mouthed portion of the container an atmosphere of the heated gas is formed. Since the container 5 being transferred by the star wheel transfer device 2 is travelling at a predetermined velocity, a dynamic pressure is produced in the proximity of the mouth portion of the container 5, and hence a static pressure within the head space becomes a negative pressure of the magnitude equivalent to the dynamic pressure produced by the velocity, so that the heated gas within the cover 20*d* will flow into the head space. For instance, assuming that the traveling velocity of the container is 1 m/sec, then the heated gas will flow into the head space up to a point close to a depth of 50 mm from the narrow-mouth of the container, and it has been confirmed that in order that a head space extending up to a point close to a depth of 70 mm may be almost filled by the heated gas, a time of 1–1.5 seconds will suffice. Then, the temperature in the proximity of the narrow-mouthed of the container is 20°–25° C. when the blowing time of the heated gas (steam) is 1–1.5 seconds and the temperature of the container is 5° C., no thermal effect upon the protein ingredients in the beer filled into the container at 2° C. is observed at all, and in the above-described manner the remaining air in the container head space including the air contained in the bubbles can be entirely removed and replaced by the heated gas.

Accordingly, the percentage of air removed from within the head space can be remarkably improved, and if the above-described apparatus is combined with an apparatus for replacing air with an inert gas (a carbon dioxide gas or the like) as will be described later, the percentage of air replaced by an inert gas can be improved, and also since it is not necessary to foam the liquid to make it overflow from the container as is the case with the known water jet system, the problems relating to loss of a liquid and contamination of machines can be also eliminated.

On the other hand, the container having the remaining air in the head space removed by the heated gas is transferred into the sealing machine 3 by means of the star wheel transfer device 2.

FIG. 7 is a cross-section view showing the general construction of the sealing machine 3, and FIG. 8 is a cross-section view taken along line E—E in FIG. 7. In FIG. 7, reference numeral 31 designates a rotary body in the sealing machine 3, which rotary body is driven in rotation by a driving device not shown. On this rotary body 31 are positioned containers 5 which have been filled with a liquid by the filling machine 2, and transferred by the star wheel transfer device 2.

In these figures, reference numeral 32 designates a sealing cam having a cam groove 32*a*. Reference numeral 21 designates a sealing plunger which is vertically moved up and down via engagement with the cam groove 32*a* in the sealing cam 32. The sealing plunger, 21 is constructed of a plunger main body 22, a throat 23 for contracting a sealing body, a sealing head 24, a sealing spring 25, a magnet 26 and a cam follower 27. Through known operations, a sealing body 28 is fed through a sealing body feeding port 22*c* and held by the magnet 26. The sealing body 28 is adapted to sealingly close the mouth portion of the container 5. Reference numeral 22*a* designates a nozzle hole for blowing out an inert gas, which is provided in the lower portion 22*b* of the plunger main body 22 and which is connected to an inert gas feed pipe 29.

When a container filled with a liquid has been supplied onto the rotary body 31, the sealing plunger 21 is lowered by the action of the cam follower 27 which engages with the cam groove 32*a* in the sealing cam 32.

As a result of lowering of the sealing plunger 21, the lower portion 22*b* of the plunger main body 22 covers the mouth portion of a container 5, and the state shown in FIG. 8 is reached. In this state, an inert gas is blown out through the nozzle hole 22*a* and is blown into the head space 5*a* of the container 5, and thereby the air within the head space 5*a* is replaced by the inert gas. In this instance, if the inert gas begins to be blown out immediately after the lower portion 22*b* of the plunger main body 22 has covered the mouth portion of the container 5, then the inside of the lower portion 22*b* of the plunger main body 22 would become filled by the inert gas, and therefore, replacement of the air by the inert gas can be achieved more effectively.

When the sealing plunger 21 is further lowered while blowing an inert gas into the plunger in the above-described manner, soon the sealing body 28 will cover the mouth portion of the container 5, subsequently the sealing body 28 is contracted by the throat 23, and then sealing is achieved.

As described in detail above, since an inert gas can be sealingly confined in the head space of a container by sealing the container in an inert gas atmosphere immediately after the air in the head space of the container has been replaced by an inert gas, the shortcoming in the prior art can be eliminated and the air within the head space can be surely replaced by an inert gas. Moreover, since provision is made such that an inert gas is blown within a plunger main body, even when the container is being transferred at a certain velocity, disturbance in the blowing of an inert gas caused by a dynamic pressure (a pressure drop generated depending upon the velocity of the container being transferred in the air) or an air flow is small, and therefore, effective replacement can be achieved.

Alternatively, in a modified embodiment illustrated in FIG. 9, an inert gas blow out nozzle 41*a* is provided at the bottom of a sealing body feeding chute 42 of a sealing body feeder at the mouth portions of containers. In this embodiment, during the period when the bottle 5 is being transferred from a filling machine towards a sealing machine by means of a star wheel transfer device 40, an inert gas is blown out of inert gas blow out nozzles 41 and 41*a*, so that a sealing body 28 fed through the chute 42 can be placed over the narrow-mouth portion of the container 5 to confine the inert gas therein immediately after the inert gas has been blown into the head space 5*a* of the container 5. Therefore, the air remaining within the head space of the container can be surely replaced by the inert gas. This modified embodiment is especially effective in the event that a nozzle for blowing out the inert gas cannot be provided in a sealing machine or the like. In FIG. 9, reference numeral 43 designates a plate for stopping and pressing a sealing body.

Since many modifications could be made in the above construction and many apparently widely different embodiments of this invention could be made without departing from the scope thereof, it is intended that all matter contained in the above description or shown in the accompanying drawings shall be interpreted as illustrative and not as a limitation to the scope of the invention.

What is claimed is:

1. In an apparatus for sealing narrow-mouthed containers and replacing air remaining in the container head space with an inert gas, said apparatus including a filling machine, a star wheel device for transferring a container filled by the filling machine to sealing means, said sealing means having a downwardly directed sealing plunger for sealing each container, an ejecting device for transferring sealed containers away from the sealing means, said apparatus having means for blowing inert gas into the head space of each container, the improvement comprising:

means disposed above said star wheel device for blowing a heated inert gas in the head space of each container and means disposed below said sealing plunger of said sealing machine, for blowing an inert gas into the head space of each container;

said means disposed above said star wheel device comprising a bubble eliminating device having a semi-annular cover which extends along the path of the containers being moved by said star wheel device, said cover having sides which extend below the level of the tops of the containers to form an enclosed heated gas retaining space above and along the path of the containers, said semi-annular cover having only a single heated gas nozzle at a position near the entrance end of said bubble eliminating device, said single heated gas nozzle connected to a supply of heated gas for blowing heated gas into the head space of narrow-mouthed containers as they are transferred by said star wheel device to said sealing means, said cover being spaced sufficiently close to the narrow-mouthed containers for retaining heated gas from said single heated gas nozzle around the tops of the containers as they move through the remainder of said cover beyond said single heated gas nozzle, whereby bubbles are eliminated in the head space of the narrow-mouthed containers and the bubbles are replaced by heated gas due to a decrease in static pressure within the containers which is equivalent to the dynamic pressure produced in the vicinity of the narrow-mouthed portion of the containers due to the velocity of the containers being transferred through said cover by said star wheel transfer device, and said means disposed below said sealing plunger includes a single nozzle for blowing an inert gas into the head space of the containers while said sealing plunger of said sealing means is lowered to cover the narrow-mouthed portion of the containers with a sealing body.

* * * * *